United States Patent [19]

Clarke

[11] 4,001,444

[45] Jan. 4, 1977

[54] BABY FOOD FEEDER

[76] Inventor: William A. Clarke, 1001 Linden Ave., Erie, Pa. 16505

[22] Filed: Jan. 10, 1975

[21] Appl. No.: 539,999

[52] U.S. Cl. ..... 426/110; 211/74; 220/90; 426/115; 248/148; 248/154; 248/362

[51] Int. Cl.[2] ..... B65D 85/72; B65D 47/40

[58] Field of Search ..... 426/104, 110, 115, 112, 426/117, 106, 131, 132; 248/148, 154, 146, 362, 363, 310, 313; 211/74; 222/45, 46, 565; 220/85 D, 90

[56] References Cited

UNITED STATES PATENTS

| | | | |
|---|---|---|---|
| 665,438 | 1/1901 | Higgins | 220/90 |
| 711,970 | 10/1902 | Hooper | 248/313 |
| 1,017,753 | 2/1912 | Harrison | 220/90 |
| 1,021,004 | 3/1912 | Sanford | 220/90 |
| 1,383,603 | 7/1921 | Craig | 220/90 |
| 1,742,069 | 12/1929 | Greenwald et al. | 248/310 |
| 2,172,140 | 9/1939 | Kieft | 248/362 |
| 2,253,565 | 8/1941 | Kinsman | 426/115 |
| 2,488,326 | 11/1949 | Pratt | 248/313 |
| 2,627,619 | 2/1953 | Cagen | 220/90 |
| 2,683,974 | 7/1954 | Brown | 220/90 |
| 2,765,094 | 10/1956 | Ryan | 220/90 |
| 3,022,916 | 2/1962 | Spooner | 220/90 |
| 3,424,351 | 1/1969 | Cilluffo et al. | 222/565 X |
| 3,476,261 | 11/1969 | Hanson et al. | 248/313 |
| 3,514,065 | 5/1970 | Litt et al. | 248/363 |
| 3,675,812 | 7/1972 | Foster | 222/565 X |
| 3,836,056 | 9/1974 | Pehr | 222/565 X |

FOREIGN PATENTS OR APPLICATIONS

| | | | |
|---|---|---|---|
| 273,474 | 4/1914 | Germany | 220/90 |

*Primary Examiner*—Steven L. Weinstein
*Attorney, Agent, or Firm*—Ralph Hammar

[57] ABSTRACT

A baby feeder having a cover for replacing the closure of a jar of baby food and providing a spoon access opening. The feeder is usable by adults and babies.

6 Claims, 5 Drawing Figures

BABY FOOD FEEDER

This invention is a device for feeding baby food which makes the job easier and which teaches baby to feed himself.

In the accompanying drawing

Figure 3:
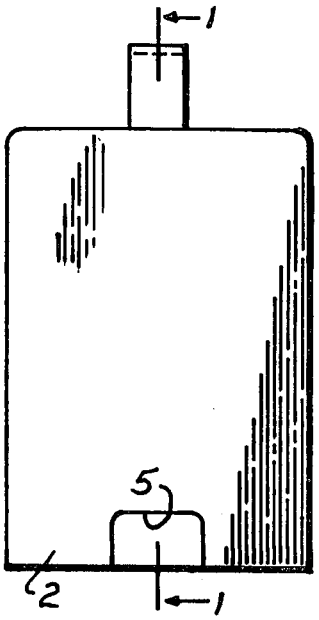
FIG. 3 is a back view of the device.
Figure 1:
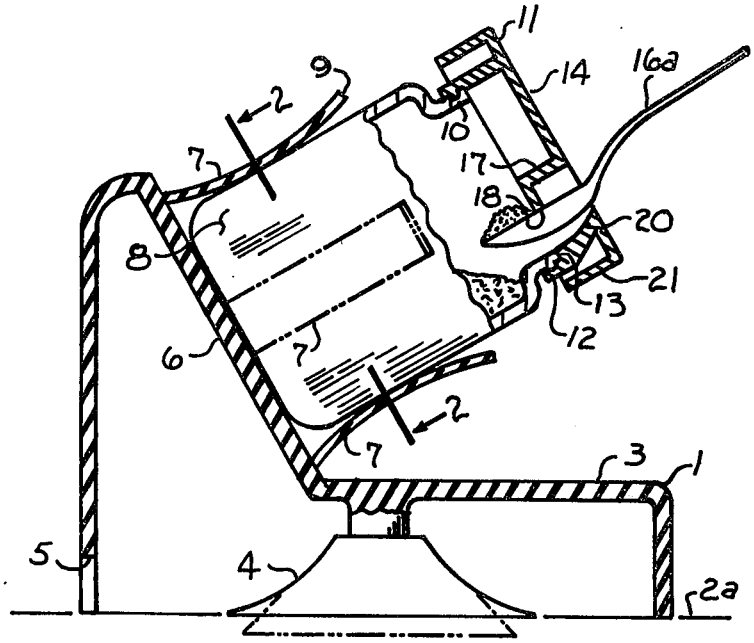
FIG. 1 is a section on line 1 of FIG. 3.
Figure 2:
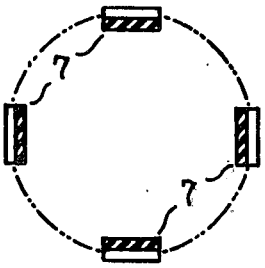
FIG. 2 is a section on line 2 — 2 of FIG. 1.

The device is carried on a hollow stand 1 having peripheral rim 2 for supporting the stand on a planar surface 2*a* such as a tray or table. At the front of the stand is a generally horizontal platform 3 on the underside of which is fixed a suction cup 4 which attaches the stand to the supporting surface. The platform 3 would be positioned facing the baby to be fed and the position of the suction cup provides a minimum of leverage for dislodging the stand by the baby. The stand can easily be removed from the supporting surface by an adult lifting the stand by means of an access hole 5 at the back. The access hole is positioned to block access by the baby and to provide greater leverage for removal by an adult.

At the back of the platform is an upright wall 6 at an acute angle to the vertical. The included angle between the front of platform 3 and wall 6 is obtuse. The wall has two functions. First it supports a plurality of spring fingers 7 distributed about a gripping circle for gripping the jar 8 of baby food. The second function of the wall 6 is to provide a stop or seat for the bottom of the jar 8 when it is inserted into the gripping fingers. The fingers have outwardly flaring ends 9 which facilitate insertion.

As manufactured the jar of baby food has at its upper end a rim 10 provided with an air tight enclosure which is removed (for example by unscrewing) before the jar is installed. To make the jar more convenient for baby feeding an auxilliary cover 11 is installed on the jar. The auxilliary cover has a rim 12 fitting on the rim 10 of the jar and having a shoulder 13 seated on the outer end of the jar rim. The rim 12 of the auxilliary cover may have screw threads complimentary to screw threads on the jar rim 10 or it may have yieldable projections which allow the auxilliary cover to be pushed on the rim of the jar. The front face 14 of the auxilliary cover is transverse to the axis of the jar and spaced axially outward from the jar rim and in its lower part has a spoon access orifice or mouth 15*a* defined by a concave or arcuate lower lip 15 radially inward from the rim 12 — and a substantially horizontal upper lip 16 extending chordwise across the lower lip. The size of the mouth is such as to provide a loose fit for the bowl of a teaspoon 16*a* when the spoon is oriented so the convex side of the bowl is presented to the concave lip 15. Extending axially inwardly from the lip 16 is a wall 17 having at its inner edge a downwardly projecting flange 18 which terminates in a leveling edge 19 for scraping excess baby food from the upper side of the bowl of a spoon. Extending rearwardly from the lower lip 15 toward the bottom of the jar is a downwardly and radially outwardly inclined concave wall 20 which acts to scrape baby food from the lower side of the bowl of the spoon and to drain the excess food back into the jar. Since the axis of the jar is inclined upward from the upper and lower sides of the bowl of the supporting surface at an acute angle, the normal movement of inserting the spoon through the mouth of the auxilliary cover, dipping the spoon into the contents of the jar and then withdrawing the spoon results in scraping excess food from the spoon so that excess food is removed and the feeding operation made neater.

While the initial use of the feeder will be by adults, the baby quickly learns to feed himself and can do so in a neat manner because excess food is scraped from the upper and lower sides of the bowl of the spoon.

Figure 5:
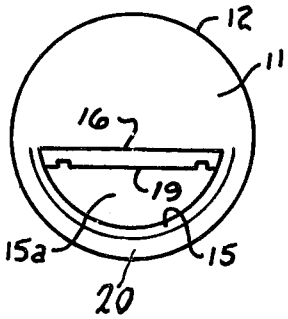
FIG. 5 is a front view of a modified form of cover.
Figure 4:
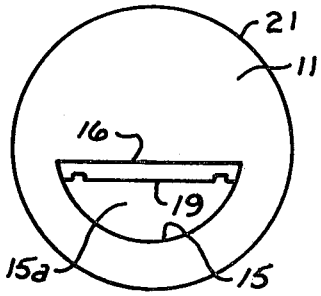
FIG. 4 is a front view of the cover.

The difference between FIG. 4 and 5 is that FIG. 4 contains an outer rim 21 which surrounds and is spaced radially outwardly from the rim 12 by which the auxilliary cover is mounted on the jar rim 10. This is a convenience in handling the auxilliary cover and has the initial function of keeping the hands of the installer away from the lips 15, 16. Also the outer rim makes the mouth 15 a easier and more encouraging target for baby. A spoon which misses the mouth will usually strike inside the rim 21 and slide along the surface 14 into the mouth. There is less chance that the spoon may miss the jar completely.

With the FIG. 5 cover, a spoon striking below the lip 15 will hit the outer surface of concave wall 20 and be deflected away from the jar.

I claim:

1. In combination with a jar of baby food having a rim at its top and removable closure on said rim, a cover substituted for said closure, said cover having:

means for mounting it on said jar rim, a front face transverse to the axis of the jar and spaced axially outward from said jar rim and having a mouth spaced axially outward from said jar rim, said mouth having a generally straight lip and another lip concave with respect to said straight lip, said mouth providing a spoon access opening with a loose fit for the bowl of a spoon through which the bowl of a spoon may be dipped into the contents of the jar with the convex side of the bowl of the spoon presented to said concave lip and with the concave side of the bowl of the spoon presented to said straight lip, a spoon leveling means recessed axially inward from said straight lip and spaced axially inward from said mouth for scraping excess food from the concave side of the bowl of the spoon as it is withdrawn through said mouth, and a concave wall extending axially inward from said concave lip to said jar rim for catching and draining into said jar food scraped from said spoon, said lips cooperating to scrape excess food from the concave and convex sides of said spoon when the bowl of said spoon is inserted through said mouth, dipped into the food in the jar to pick up food in the bowl and then withdrawn through said opening.

2. The combination of claim 1 in which the spoon levelling means is further defined as a wall extending axially inwardly from said straight lip and having at its inner edge a flange extending toward said concave wall and which terminates in a levelling edge for scraping excess food from the concave side of the bowl of the spoon.

3. The combination of claim 1 in which the included angle between the axis of the jar and the intersection with said wall of a plane including said axis is an acute angle.

4. The combination of claim 1 with a stand for resting on a horizontal planar surface, said stand having a generally horizontal platform at the front of the stand, an upright wall extending from the rear of the platform, said upright wall having a surface for seating the bottom of the jar, the included angle between said surface and the front of said platform being an obtuse angle, and the stand having means for releasably gripping the jar and holding it with its bottom adjacent said surface and its rim extending toward the front of said platform and its axis inclined upward from said platform at an acute angle to the front of said platform.

5. The combination of claim 4 in which the gripping means comprises spring fingers extending axially along the jar from said surface.

6. The combination of claim 5 in which the stand has a hollow back having a front face presented to the front of the platform and constituting said surface substantially normal to the axis of the jar and from which the gripping fingers extend.

* * * * *